US012693057B2

(12) United States Patent
Mandel et al.

(10) Patent No.: US 12,693,057 B2
(45) Date of Patent: Jul. 28, 2026

(54) VAPOR COMPRESSION CYCLE WITH DIRECT PUMPED TWO-PHASE COOLING

(71) Applicant: Hamilton Sundstrand Corporation, Charlotte, NC (US)

(72) Inventors: Raphael Mandel, West Hartford, CT (US); Ram Ranjan, San Diego, CA (US); Joseph E. Turney, Amston, CT (US)

(73) Assignee: HAMILTON SUNDSTRAND CORPORATION, Charoltte, NC (US)

( * ) Notice: Subject to any disclaimer, the term of this patent is extended or adjusted under 35 U.S.C. 154(b) by 219 days.

(21) Appl. No.: 18/532,348

(22) Filed: Dec. 7, 2023

(65) Prior Publication Data

US 2025/0189189 A1 Jun. 12, 2025

(51) Int. Cl.
*F25B 43/04* (2006.01)
*F25B 13/00* (2006.01)

(52) U.S. Cl.
CPC ..... *F25B 43/04* (2013.01); *F25B 13/00* (2013.01)

(58) Field of Classification Search
CPC ..... F25B 43/04; F25B 13/00; F25B 49/02; F25B 2400/23; F25B 2400/24; F25B 2700/21174; F25B 41/39
USPC ..... 62/115
See application file for complete search history.

(56) References Cited

U.S. PATENT DOCUMENTS 7,716,943 B2 * 5/2010 Seefeldt ..... F25B 13/00 62/506
10,775,110 B2 9/2020 Snyder et al.
10,906,150 B2 * 2/2021 Jansen ..... F25B 25/005
10,921,042 B2 2/2021 Donovan et al.
11,022,360 B2 6/2021 Donovan et al.
11,435,145 B2 9/2022 Khalili et al.
11,644,251 B2 5/2023 Vaisman et al.
(Continued)

FOREIGN PATENT DOCUMENTS

CN 110455001 A * 11/2019 ..... F25B 43/02
EP 3502587 A1 * 6/2019 ..... F25B 6/04
(Continued)

OTHER PUBLICATIONS

Extended European Search Report for EP Application No. 24218174.1, dated Apr. 10, 2025, pp. 1-7.

*Primary Examiner* — Eric S Ruppert
*Assistant Examiner* — Kirstin U Oswald
(74) *Attorney, Agent, or Firm* — CANTOR COLBURN LLP

(57) ABSTRACT

Thermal management systems include a vapor cycle and a liquid cycle sharing a common working fluid. The vapor cycle includes, along a vapor cycle flow path, a compressor and a condenser. The liquid cycle includes, along a liquid cycle flow path, a fluid driver, a load, a regulator valve, and a phase change material heat exchanger. A cold sink is thermally coupled to a heat load. A separator is configured to separate liquid and vapor portions of the working fluid and direct the liquid into the liquid cycle and the vapor into the vapor cycle. The separator is part of both the vapor cycle and the liquid cycle. The regulator valve controls a temperature of the working fluid within the liquid cycle at a location upstream of the phase change material heat exchanger to control a mode of operation of the phase change material heat exchanger.

16 Claims, 4 Drawing Sheets

(56) References Cited

U.S. PATENT DOCUMENTS

| | | | | |
|---|---|---|---|---|
| 11,744,042 | B2 | 8/2023 | Snyder | |
| 11,761,712 | B2 | 9/2023 | Donovan et al. | |
| 2005/0097909 | A1* | 5/2005 | Cleland | B67D 1/06 62/224 |
| 2006/0162358 | A1* | 7/2006 | VanderZee | F25B 49/02 62/225 |
| 2007/0104233 | A1* | 5/2007 | Vetrovec | H01S 3/042 257/E23.089 |
| 2008/0202155 | A1* | 8/2008 | Taras | F24F 3/153 62/515 |
| 2009/0133412 | A1* | 5/2009 | Narayanamurthy | F25D 16/00 62/66 |
| 2012/0151960 | A1* | 6/2012 | Guerra | F25B 15/02 62/476 |
| 2015/0069758 | A1* | 3/2015 | Davidson | F01K 25/10 60/659 |
| 2015/0135743 | A1* | 5/2015 | Dobbs | F24F 11/86 62/126 |
| 2015/0285539 | A1* | 10/2015 | Kopko | F25B 41/39 62/324.1 |
| 2016/0076821 | A1* | 3/2016 | Kopko | F28D 20/0039 165/10 |
| 2017/0307264 | A1* | 10/2017 | Clodic | F25B 30/02 |
| 2017/0314830 | A1* | 11/2017 | Klemen | F25B 43/006 |
| 2019/0314945 | A1* | 10/2019 | Jansen | B23Q 11/141 |
| 2019/0360730 | A1* | 11/2019 | Hagh | F25B 49/02 |
| 2022/0169903 | A1* | 6/2022 | Pottker | C09K 5/045 |
| 2022/0404105 | A1 | 12/2022 | Vaisman et al. | |
| 2023/0324093 | A1* | 10/2023 | Arnou | F25B 25/005 62/115 |

FOREIGN PATENT DOCUMENTS

| | | | | |
|---|---|---|---|---|
| JP | 2001221517 | A * | 8/2001 | F25B 1/10 |
| WO | WO-8800319 | A1 * | 1/1988 | F25B 9/006 |
| WO | WO-2013102537 | A2 * | 7/2013 | F28D 20/028 |
| WO | WO-2020036755 | A1 * | 2/2020 | F01D 15/10 |
| WO | WO-2024206838 | A1 * | 10/2024 | F25B 25/005 |

* cited by examiner

VAPOR COMPRESSION CYCLE WITH DIRECT PUMPED TWO-PHASE COOLING

BACKGROUND

The subject matter disclosed herein generally relates to thermal management systems and, more particularly, to vapor compression cycles with direct pumped two-phase cooling.

Some conventional thermal management systems on aircraft utilize air cycle cooling. Hot, pressurized air from the engine is cooled and compressed and used to cool avionics systems and environmental systems, such as the cabin and flight deck. Advancements in composite materials have introduced light yet strong composite components to replace heavier metal components on aircraft. For example, aircraft wings can contain multiple composite components to form a largely composite wing. Composite components do have certain drawbacks, however. Some composite components cannot withstand the high temperatures of the pressurized air bled from the engine that is used for cooling. Thus, using conventional air cycle cooling alone can be unsuitable in some aircraft constructed with composite components. In these cases, alternate thermal management systems must be used.

Thermal management of temperature-sensitive components under harsh environments may require a coolant at temperatures below ambient temperature. Typically, this is accomplished using a vapor compression cycle to chill a secondary (indirect) coolant to a required sub-ambient temperature, at the expense of system efficiency, size, and weight due to the required additional components and inefficiencies. Conventional vapor cycle cooling utilizes hydrofluorocarbon refrigerants, such as R-134a. Refrigerant vapor cycle systems offer good performance relative to system weight. Thermal Management Systems (TMS) are often required to provide coolant temperatures within a relatively narrow range of temperatures to prevent damage to sensitive electronic components, such as high energy lasers. High energy lasers also typically operate in a low duty cycle, where the device is at peak power for only a small fraction of the time.

As noted, a typical TMS usually consists of a vapor compression cycle that provides cold refrigerant in an evaporator which absorbs heat from a separate, indirect liquid loop. The liquid loop is then used to cool the electronic components. The indirect loop provides a large amount of thermal mass to dampen temperature changes and additional flexibility. However, integrating thermal energy storage to such a loop requires either the use of a heat exchanger with three phases (i.e., refrigerant, coolant, and phase change material (PCM)), which has two-times reduced surface area and therefore approximately twice larger mass or a heat exchanger in a pumped liquid loop which must be oversized to minimize temperature swings between freezing and melting of the PCM. These oversized heat exchangers further increase the weight of the thermal management system. Accordingly, it may be desirable to have systems that are more efficient, provide lower weight, and may provide less risk to the environment.

SUMMARY

According to some embodiments, thermal management systems are provided. The thermal management systems include a vapor cycle and a liquid cycle sharing a common working fluid, wherein the vapor cycle comprises, along a vapor cycle flow path, a compressor and a condenser, and wherein the liquid cycle comprises, along a liquid cycle flow path, a fluid driver, a load, a regulator valve, and a phase change material heat exchanger, a cold sink thermally coupled to a heat load, and a separator configured to separate a liquid portion and a vapor portion of the working fluid and direct the liquid portion into the liquid cycle and the vapor portion into the vapor cycle, wherein the separator is part of both the vapor cycle and the liquid cycle. The regulator valve is configured to control a temperature of the working fluid within the liquid cycle at least at a location upstream of the phase change material heat exchanger to control a mode of operation of the phase change material heat exchanger.

In addition to one or more of the features described herein, or as an alternative, further embodiments of the thermal management systems may include that the mode of operation of the phase change material heat exchanger is a discharging mode of operation where the temperature of the working fluid upstream of the phase change material heat exchanger is higher than a melting point of a phase change material of the phase change material heat exchanger.

In addition to one or more of the features described herein, or as an alternative, further embodiments of the thermal management systems may include that the mode of operation of the phase change material heat exchanger is a recharging mode of operation where the temperature of the working fluid upstream of the phase change material heat exchanger is less than a melting point of a phase change material of the phase change material heat exchanger.

In addition to one or more of the features described herein, or as an alternative, further embodiments of the thermal management systems may include that the regulator valve is actively controlled to adjust a pressure drop across the regulator valve to adjust the temperature of the working fluid upstream of the phase change material heat exchanger.

In addition to one or more of the features described herein, or as an alternative, further embodiments of the thermal management systems may include at least one temperature sensor arranged on the liquid cycle to measure a temperature of the working fluid and a controller operably connected to the regulator valve and configured to receive temperature information from the at least one temperature sensor.

In addition to one or more of the features described herein, or as an alternative, further embodiments of the thermal management systems may include that the regulator valve is passively controlled in response to a temperature of the working fluid passing through the regulator valve.

In addition to one or more of the features described herein, or as an alternative, further embodiments of the thermal management systems may include a recuperator arranged on the liquid cycle at a position upstream from the load to receive a first pass of the working fluid and at a position downstream from the load to receive a second pass of the working fluid to cause a thermal exchange between a heated portion of the working fluid downstream from the load and a relatively colder portion of the working fluid upstream from the load.

In addition to one or more of the features described herein, or as an alternative, further embodiments of the thermal management systems may include that the heated portion of the working fluid passes from the recuperator to the regulator valve.

In addition to one or more of the features described herein, or as an alternative, further embodiments of the thermal management systems may include that the load is an onboard aircraft load.

In addition to one or more of the features described herein, or as an alternative, further embodiments of the thermal management systems may include that the load is a high energy laser.

According to some embodiments, methods of operating thermal management systems are provided. The controlled thermal management systems includes a vapor cycle and a liquid cycle sharing a common working fluid. The vapor cycle comprises, along a vapor cycle flow path, a compressor and a condenser, and the liquid cycle includes, along a liquid cycle flow path, a fluid driver, a load, a regulator valve, and a phase change material heat exchanger, a cold sink thermally coupled to a heat load. A separator is configured to separate a liquid portion and a vapor portion of the working fluid and direct the liquid portion into the liquid cycle and the vapor portion into the vapor cycle, and the separator is part of both the vapor cycle and the liquid cycle. The method includes controlling a temperature of the working fluid within the liquid cycle at least at a location upstream of the phase change material heat exchanger using the regulator valve to control a mode of operation of the phase change material heat exchanger.

In addition to one or more of the features described herein, or as an alternative, further embodiments of the methods may include that the mode of operation of the phase change material heat exchanger is a discharging mode of operation where the temperature of the working fluid upstream of the phase change material heat exchanger is higher than a melting point of a phase change material of the phase change material heat exchanger.

In addition to one or more of the features described herein, or as an alternative, further embodiments of the methods may include that the mode of operation of the phase change material heat exchanger is a recharging mode of operation where the temperature of the working fluid upstream of the phase change material heat exchanger is less than a melting point of a phase change material of the phase change material heat exchanger.

In addition to one or more of the features described herein, or as an alternative, further embodiments of the methods may include that the regulator valve is actively controlled to adjust a pressure drop across the regulator valve to adjust the temperature of the working fluid upstream of the phase change material heat exchanger.

In addition to one or more of the features described herein, or as an alternative, further embodiments of the methods may include measuring a temperature of the working fluid with at least one temperature sensor arranged on the liquid cycle and using a controller operably connected to the regulator valve to receive temperature information from the at least one temperature sensor and adjust the regulator valve in response to the measured temperature.

In addition to one or more of the features described herein, or as an alternative, further embodiments of the methods may include that the regulator valve is passively controlled in response to a temperature of the working fluid passing through the regulator valve.

In addition to one or more of the features described herein, or as an alternative, further embodiments of the methods may include a recuperator arranged on the liquid cycle at a position upstream from the load to receive a first pass of the working fluid and at a position downstream from the load to receive a second pass of the working fluid to cause a thermal exchange between a heated portion of the working fluid downstream from the load and a relatively colder portion of the working fluid upstream from the load.

In addition to one or more of the features described herein, or as an alternative, further embodiments of the methods may include that the heated portion of the working fluid passes from the recuperator to the regulator valve.

In addition to one or more of the features described herein, or as an alternative, further embodiments of the methods may include that the load is an onboard aircraft load.

In addition to one or more of the features described herein, or as an alternative, further embodiments of the methods may include that the load is a high energy laser.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
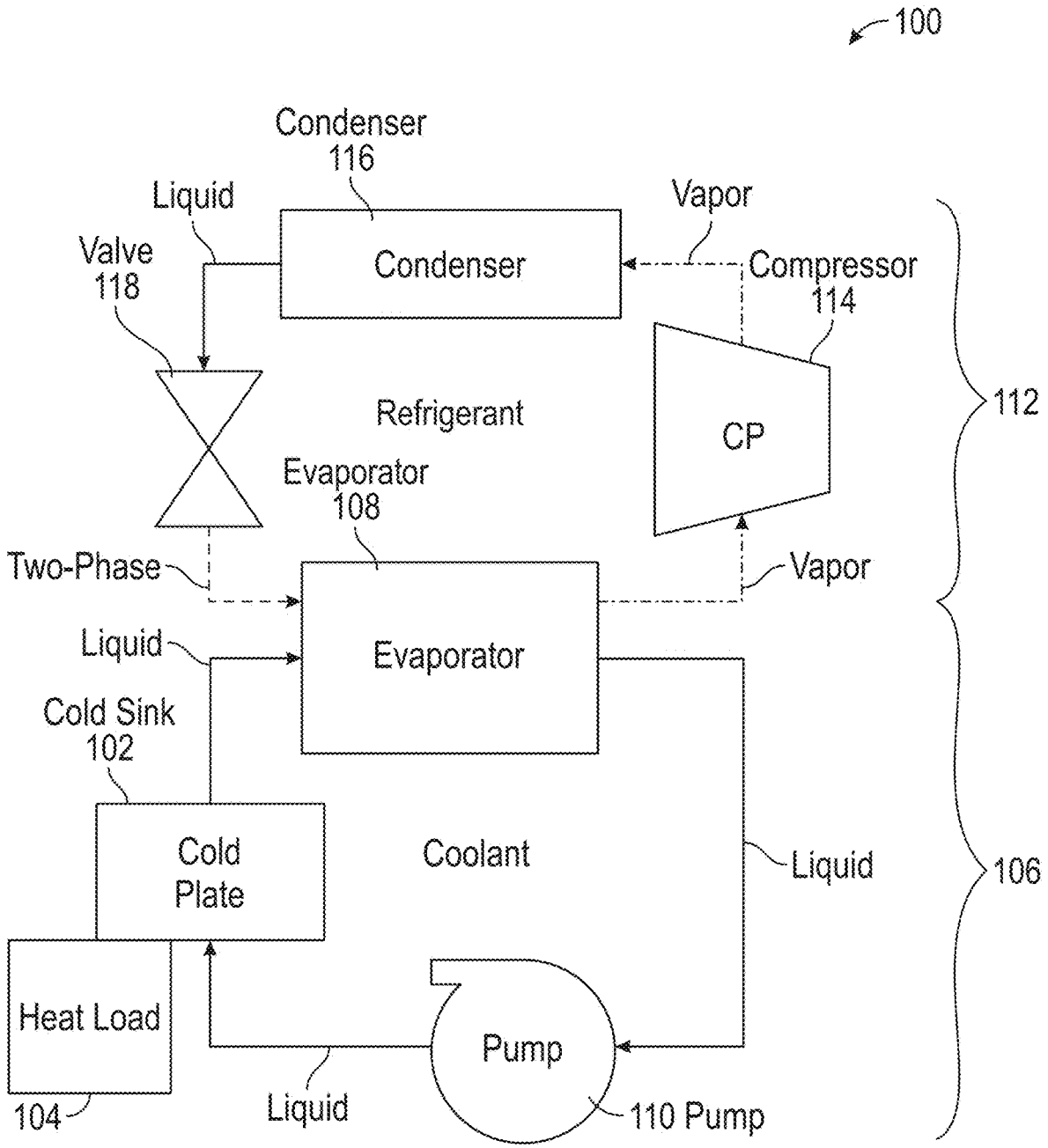
FIG. 1 is a schematic illustration of a conventional two-fluid thermal management system.

As shown and described herein, various features of the disclosure will be presented. Various embodiments may have the same or similar features and thus the same or similar features may be labeled with similar reference numerals. Although similar reference numbers may be used in a generic sense, various embodiments will be described and various features may include changes, alterations, modifications, etc. as will be appreciated by those of skill in the art, whether explicitly described or otherwise would be appreciated by those of skill in the art. Further, it will be appreciated that, unless otherwise stated, features from the various separately described embodiments may be combined in various combinations and each embodiment is not intended to be mutually exclusive from features of other embodiments described herein and/or mutually exclusive from other features and components not explicitly described.

Referring to FIG. 1, a schematic illustration of a conventional two-fluid cooling cycle 100 is shown. The two-fluid cooling cycle 100 is configured to provide a cold sink 102 that is thermally coupled with one or more components and/or fluids associated with one or more components (illustrated as heat load 104), to provide cooling thereto. For example, in some embodiments or configurations, the cold sink 102 may be a cold plate having internal fluid passages for receiving a fluid of the two-fluid cooling cycle 100 which absorbs heat from the heat load 104. In some configurations, the two-fluid cooling cycle 100 may be described as a vapor cycle loop that is thermally connected to a liquid loop. The heat load 104 may be power electronics, a working fluid line of a cooling loop/cycle, or the like, and/or portions thereof as will be appreciated by those of skill in the art. The heat load 104, and heat loads described and employed herein, may be, for example and without limitation, electronic devices such as computer processes, motor controllers, radio/radar systems, power amplifiers, diodes, inductors, motors, and/or other electric and/or electronic devices.

To operate as a source of heat removal from the heat load 104, the cold sink 102 is part of a coolant loop 106. The coolant loop 106 is a closed-loop system that includes the cold sink 102, an evaporator 108, and a pump 110. The coolant loop 106 includes a coolant fluid within a closed-loop flow path that passes from the cold sink 102, into and through the evaporator 108, is pumped up in pressure at the pump 110, and returned to the cold sink 102. As the coolant passes through the cold sink 102, it will pick up heat from the heat load 104 and increase in temperature. The heated coolant will then enter the evaporator 108 where excess heat will be extracted and the coolant will be cooled. The cooled coolant will then be increased in pressure at the pump 110 to ensure that the coolant is in a liquid phase prior to entering the cold sink 102. It will be appreciated that in some configurations, the coolant of the coolant loop 106 remains in a liquid phase throughout the coolant loop 106, thereby preventing or avoiding inefficiencies due to phase changes and/or flow disruptions.

The heat picked up by the coolant of the coolant loop 106 within the cold sink 102 is removed at the evaporator 108. The evaporator 108 is part of the coolant loop 106 and part of a refrigerant loop 112. The evaporator 108 receives, as a first working fluid, the coolant of the coolant loop 106 and, as a second working fluid, a refrigerant of the refrigerant loop 112. The refrigerant will pick up heat from the coolant of the coolant loop 106 within the evaporator 108 and enter a vapor phase. The heated refrigerant (vapor) will then be compressed within a compressor 114, condensed (from vapor to liquid) within a condenser 116 (e.g., a heat exchanger to remove heat), and then expanded within or through a valve 118 before returning to the evaporator 108 as a two-phase fluid, where it will pick up heat and evaporate into the vapor phase through interaction with the heated coolant of the coolant loop 106 within the evaporator 108. The valve 118 may be an expansion valve, controllable valve, or the like, as will be appreciated by those of skill in the art.

Thermal management of temperature-sensitive components under harsh environments often require a coolant at temperatures below ambient. The two-fluid cooling cycle 100 shown in FIG. 1 provides such cooling. A vapor compression cycle (e.g., refrigerant loop 112) is used to chill a secondary (indirect) coolant (e.g., coolant loop 106) to required sub-ambient temperatures (FIG. 1), at the expense of system efficiency, size, and weight due to the required components and inefficiencies. For example, excess vapor cycle temperatures lift may be required to drive heat transfer in an evaporator. Further, relatively large flow rates may be required in a liquid portion of the loop(s) to maintain consistent cooling for high heat loads. Furthermore, additional temperature lift may be required to drive heat transfer in the condenser, particularly if the coolant temperature is below ambient. These and other inefficiencies may be addressed, at least in part, through implementations of embodiments of the present disclosure.

In the two-fluid cooling cycle 100 of FIG. 1, two separate working fluids are used. A coolant is used in the coolant loop 106 and a separate refrigerant is used in the refrigerant loop 112. In some configurations, the coolant of the coolant loop 106 may be, for example and without limitation, water, propylene-glycol water mixture, ethylene-glycol water mixture, etc., and the refrigerant of the refrigerant loop 112 may be, for example and without limitation, 1,1,1,2-Tetrafluoroethane (R-134a), a mixture of difluoromethane and pentafluoroethane (R-410A), 2,3,3,3-Tetrafluoropropene (R-1234yf), or 1,1,1,3,3,3-Hexafluoropropane (236fa), etc. Using two separate fluids can result in inefficiencies, such as requiring two separate fluid systems, ensuring proper thermal exchange occurs at the correct locations of the respective loops, and the like.

The two-fluid cooling cycle 100 consists of a vapor compression cycle (e.g., refrigerant loop 112) that provides cold refrigerant in an evaporator (e.g., evaporator 108) which absorbs heat from a separate, indirect liquid loop (e.g., coolant loop 106). The liquid loop is then used to cool the heat load (e.g., heat load 104, such as electronic components). The indirect loop provides a large amount of thermal mass to dampen temperature changes and additional flexibility. However, integrating thermal energy storage to such a loop requires either the use of a heat exchanger in the pumped liquid loop which must be oversized to minimize the temperature swings between freezing and melting of a phase change material, or a heat exchanger with three phases (refrigerant, coolant, and phase change material), which has two-times reduced surface area and therefore approximately twice larger mass. These oversized heat exchangers further increase the weight of the thermal management system.

In view of the above and to provide other advantages, embodiments of the present disclosure are directed to a vapor compression cycle system with an attached pumped two-phase loop. Such systems may be both lighter weight and more efficient as compared to the conventional systems. For example, the evaporator (e.g., evaporator 108) can be replaced with a separator (e.g., liquid/gas separator), which weighs less and requires no temperature difference, thereby improving efficiency. However, the reduced thermal mass of the coolant may make such systems more susceptible to changing conditions, and in systems with sensitive components that have strict tolerances on temperature swings, the improved cycle may not be feasible without further components, considerations, or operational parameters.

Accordingly, in accordance with some embodiments of the present disclosure, vapor compressor cycle systems are provided having a modified hybrid vapor compression cycle with a pumped two-phase loop. In accordance with some embodiments, a pressure regulator valve may be arranged after or downstream from a load along a fluid flow path. The pressure regulator may be used to regulate a saturation pressure on an outlet side of the load to keep the saturation temperature constant. During a discharging mode of a phase change material (PCM), the pumped two-phase loop may be warmer than a melting point of the PCM. In some embodiments, the pumped two-phase loop is isothermal. In contrast, during a charging mode of the PCM, the pumped two-phase loop may be colder than the melting point of the PCM. The inclusion of a pressure regulator valve may enable pressurizing of the load up to a saturation point in the discharging mode in order to maintain a constant temperature. In some embodiments, downstream from the regulator valve along a fluid flow path, the pressure may drop back down below the melting point of the PCM to recharge it. Thus, in various configurations of the present disclosure, a refrigerant coolant (e.g., fluid) may be sub-cooled as it enters the load. The amount of heat required to bring the fluid up to saturation is typically a small fraction of the load and the vast majority of the coolant in the load is at the fixed saturation temperature. However, in some embodiments, if the subcooling is significant compared to the load, a recuperator can be arranged upstream from the load to preheat the fluid. In such configurations, because the hot side (relative to the load) is the fluid leaving the load, there is no concern of boiling the fluid.

Figure 2:
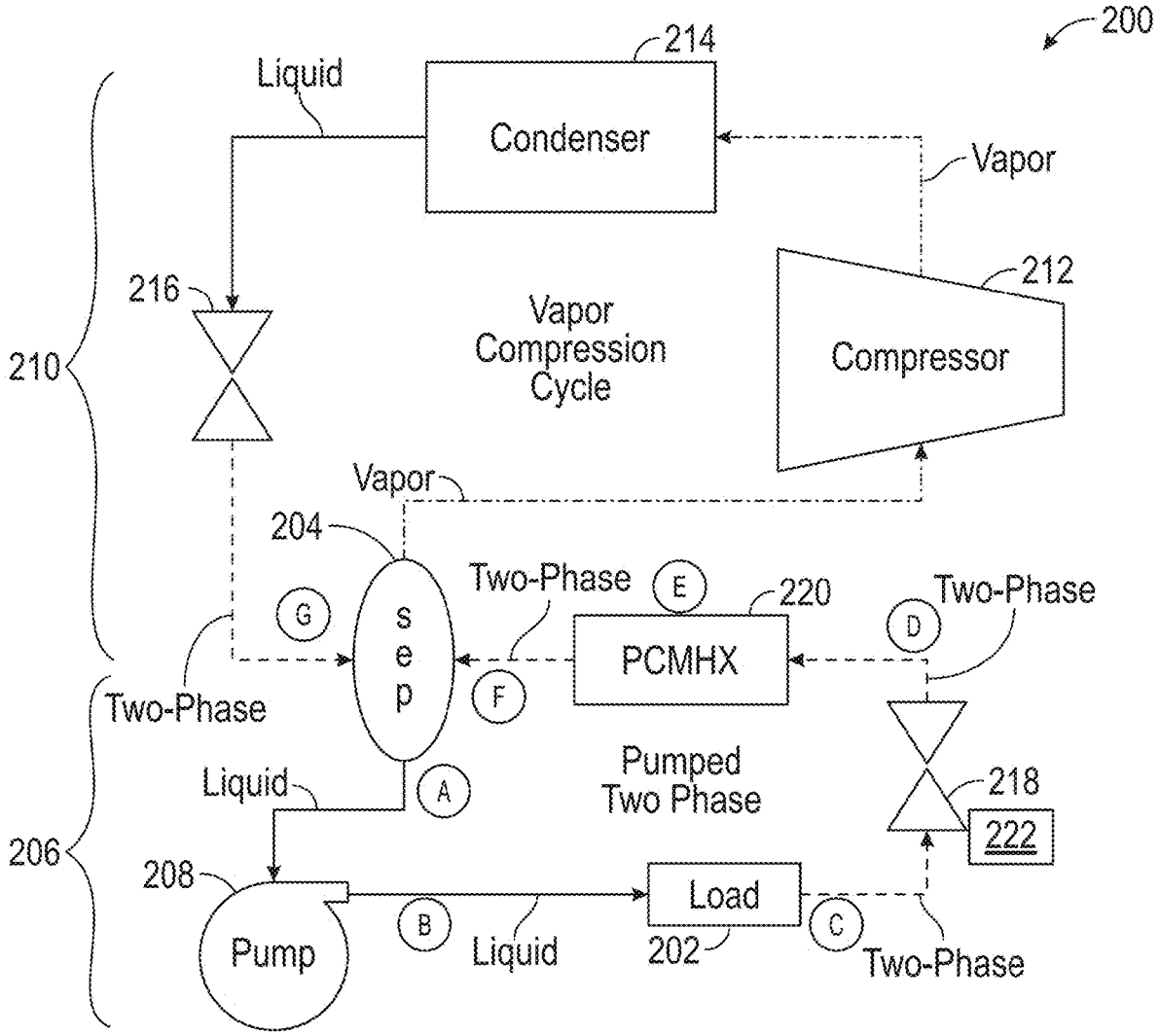
FIG. 2 is a schematic illustration of a single fluid thermal management system in accordance with an embodiment of the present disclosure.

Referring now to FIG. 2, a schematic illustration of a single-fluid, two-phase thermal management system 200 in accordance with an embodiment of the present disclosure is shown. In contrast to the system shown in FIG. 1, which uses two separate cooling loops, the thermal management system 200 is a single-fluid system that uses a single working fluid for both a vapor compression cycle (e.g., vapor cycle 210) and a pumped two-phase cooling cycle (e.g., liquid cycle 206). The thermal management system 200 is configured to provide cooling to a load 202, which may be arranged as a cold plate that is thermally coupled to a heat load (e.g., electronics component, other system requiring cooling, or the like) or may be directly coupled to a load to provide cooling thereto. In this configuration, a single working fluid (e.g., a single refrigerant) is used in both cycles of the thermal management system 200, and the working fluid may be a two-phase fluid that may have a vapor phase, a liquid phase, and a two-phase state, which is a mixture of both liquid and vapor phases.

With such a working fluid, the phase state of the working fluid may change depending on where within the thermal management system 200 the working fluid is located. For example, the working fluid may exit the load 202 as a two-phase fluid due to heat pickup from the coupled heat load, where the temperature may be sufficient to boil at least a portion of the working fluid. This two-phase state of the working fluid may be separated into liquid and vapor components within a separator 204 and distributed through the two cycles of the thermal management system 200. For example, a liquid portion of the two-phase working fluid within the separator 204 will be directed into the liquid cycle 206 of the thermal management system 200 and a vapor portion of the two-phase working fluid within the separator 204 will be directed into the vapor cycle 210 of the thermal management system 200.

The liquid portion of the two-phase working fluid, sourced from the separator 204, is increased in pressure through a fluid driver 208 and directed into the load 202 (or a cold plate heat exchanger coupled to the load 202) for cooling purposes. The fluid driver 208 may be a pump or the like that is configured to increase a pressure of the working fluid. The fluid driver 208 may be configured to control a flow rate of the working fluid through the thermal management system 200, and particularly through the liquid cycle 206 of the thermal management system 200. The fluid driver 208 may be, for example, a positive displacement pump or the like. As will be appreciated by those of skill in the art, the fluid driver 208 may be configured to increase a pressure of the working fluid sufficiently to overcome pressure drops introduced by various components within the system but may not be sufficient to change a fluid state of the working fluid. The liquid portion is provided to interact with the load 202 and at least partially boil, causing the working fluid to transition to a two-phase state and then passed through a regulator valve 218 and a phase-change material heat exchanger 220. The two-phase state of the working fluid is then directed back into the separator 204.

The vapor portion of the working fluid within the separator 204 is directed into the vapor cycle 210. The vapor portion of the working will be compressed (in the vapor state) through a compressor 212 and subsequently condensed into a liquid state at or through a condenser 214. The liquid state of the working fluid that is generating at the condenser 214 within the vapor loop 210 is then expanded into a two-phase state at a valve 216. The valve 216 may be a pressure valve of the like, that may increase a pressure, and thus temperature, of the working fluid, and cause the working fluid to transition from a liquid state into a two-phase state. The two-phase state working fluid from the vapor cycle 210 is joined at the separator 204 with the two-phase state working fluid from the liquid cycle 204, and then separated again and directed back into the respective cycles 206, 210.

As shown, the liquid cycle 206 is configured to receive the liquid working fluid at the fluid driver 208. The fluid driver 208 increases the pressure of the liquid working fluid prior to being directed to the load 202. As the liquid working fluid thermally interacts with the load 202, the working fluid will be heated through heat pickup from the load. The working fluid will then transition from a liquid state or phase at an inlet side of the load 202 to a two-phase state at an outlet side of the load 202. This change in phase/state occurs because the load 202 may be at sufficiently high temperature to cause the working fluid to at least partially boil, resulting in a two-phase mixture of liquid and vapor.

In the liquid cycle 206, downstream from the load 202, the two-phase working fluid will pass through the regulator valve 218, described in more detail below, and into the phase change material (PCM) heat exchanger 220. The PCM heat exchanger 220 is a thermal energy storage and exchange device that is arranged in the liquid cycle 206 between the regulator valve 218 and the separator 204. The PCM heat exchanger 220 may have various configurations, such as and without limitation, a plate-fin configuration, a microchannel configuration, a two-channel configuration, or the like. In operation, for example, the two-phase working fluid enters a manifold of the PCM heat exchanger 220 from the regulator valve 218 and flows through multiple parallel channels of the PCM heat exchanger 220 and exits through an outlet manifold of the PCM heat exchanger 220. The parallel channels may be configured to pass through or be thermally coupled to a phase change material (e.g., paraffin) of the PCM heat exchanger 220 for performing thermal energy exchange with the working fluid (e.g., thermal energy storage or supply).

The thermal management system 200 may be configured to operate in a discharging mode of operation and a charging mode of operation, depending on whether the PCM within the PCM heat exchanger 220 should be charged or discharged. In the charging mode of operation, the PCM is used to store energy from the working fluid of the thermal management system 200. In the discharging mode of operation, the PCM is used to supply energy into the working fluid of the thermal management system 200. During the charging mode, a relatively cool working fluid is used to cause, for example, crystallization of the PCM contained within the PCM heat exchanger 220, and thus energy may be stored (e.g., as latent heat) within the PCM.

The PCM discharging mode of the thermal management system 200 will now be described. In the PCM discharging mode, the liquid cycle 206 (e.g., a pumped two-phase loop) is warmer than the melting point of the PCM in the PCM heat exchanger 220, and the pumped two-phase loop is isothermal. For example, using relatively arbitrary temperature values for example purposes only, a liquid working fluid may exit the separator 204 at Point A at 15° C. The working fluid is then boosted in pressure at the fluid driver 208 while the temperature of the working fluid remains the same (e.g., 15° C.). The increased pressure liquid phase of the working fluid, at Point B is supplied into thermal communication with the load 202 where it will pick up heat from the load 202. At Point C, the working fluid exits the load 202 as a two-phase fluid (e.g., mixture of liquid and vapor). The two-phase state of the working fluid is achieved due to the heat picked up at the load 202, where a portion of the working fluid will vaporize.

The two-phase fluid working fluid, at Point C, may have a constant temperature and pressure. In this non-limiting example, the two-phase working fluid, at Point C, may have a temperature of 15° C. The regulator valve 218 will pressure regulate the working fluid and direct the two-phase working fluid at Point D toward the PCM heat exchanger 220 with the working fluid being maintained at 15° C. As the two-phase working fluid passes through the PCM heat exchanger 220, with the discharging mode being isothermal, the working fluid passes through the PCM heat exchanger 220 at Point E and exits the PCM heat exchanger 220 at Point F with a constant temperature (e.g., 15° C. in this example), and then re-enters the separator 204.

The PCM heat exchanger 220 includes a phase change material that changes state or phase due to thermal changes and may have a melting point which causes the phase state of the material to change. In this example, the phase change material may have a melting point of 10° C. As such, in the discharging mode of this example, the temperature of the two-phase working fluid (15° C.) is above the melting point of the phase change material. That is, in the discharging mode, the phase change material of the PCM heat exchanger 220 is melted by the relatively higher temperature working fluid. This temperature may be ensured through the operation of the regulator valve 218, which is operated either actively or passively to achieve the appropriate temperature of the working fluid at Point D, where it enters the PCM heat exchanger 220.

It is noted that the portion of the working fluid passed through the vapor cycle 210 will enter the separator 204 as a two-phase fluid having a temperature of 15° C., at Point G, and the two two-phase portions of the working fluid will mix and then be separated at the separator 204. The cycles may then continue with the vapor portion of the working fluid passing into the vapor cycle 210 and the liquid portion of the working fluid passing into the liquid cycle 206.

In this same configuration, but during a PCM charging mode of operation, the regulator valve 218 may be operated or controlled to ensure that the temperature of the working fluid as it enters the PCM heat exchanger 220 (e.g., at Point D) is below the melting point of the phase change material. For example, in such a charging mode, the regulator valve 218 may cause a pressure drop across the regulator valve 218 such that the temperature of the working fluid that exits the regulator valve 218 is at a temperature below the melting point of the phase change material. In a non-limiting example, also using arbitrary temperature values and with the PCM having a melting point of 10° C., the regulator valve 218 may cause a decrease in the pressure of the working fluid such that the temperature of the working fluid (in two-phase state) at Point D is dropped to 5° C. (e.g., from a heated state after exiting the load 202). The 5° C. working fluid is then supplied into the PCM heat exchanger 220 at Point E where it may cause the PCM within the PCM heat exchanger to change phase such as transition from a vapor state to a liquid state or a liquid state to a solid state. The relatively cold working fluid will interact with the PCM to cause the phase change, but due to the pressure control provided by the regulator valve 218 may remain at 5° C.

The regulator valve 218 thus may be used to control a temperature of the working fluid through the entire thermal management system 200, except for where the working fluid picks up heat from load 202, or as the working fluid passes through the compressor 212, condenser 214, and valve 216 of the vapor cycle 210. In some configurations, the valve 216 of the vapor cycle 210 may operate similarly as the regulator valve 218 such that a two-phase portion of the working fluid entering the separator 204 from the vapor cycle 210 (e.g., at Point G) has the same temperature (5° C.) as the working fluid entering the separator 204 from the PCM heat exchanger 220. The separator 204 will then direct a vapor portion of the working fluid into the vapor cycle 210 and a liquid portion to the liquid cycle 206.

In this example, by operation of the regulator valve 218, the liquid portion of the working, at Point A, will have a temperature of 5° C. The liquid working fluid is boosted in pressure and a flow rate is ensured at the fluid driver 208 and directed along Point B as a liquid at 5° C. The liquid working fluid will then thermally interact with the load 202 and pick up heat, thus increasing the temperature of the working fluid. As such, at Point C, the working fluid may be in a two-phase state having an increased temperature of, for example, 15° C. The two-phase working fluid is then passed into and through the regulator valve 218 which provides a pressure drop to cause the temperature of the two-phase working fluid to drop to 5° C. (or other temperature below the melting point of the PCM).

In accordance with embodiments of the present disclosure, during the charging mode, the pumped two-phase loop (liquid cycle 206) is colder than the melting point of the PCM. However, in the discharging mode, the regulator valve 218 is used to pressurize the load 202 up to its saturation point in order to maintain a constant temperature. Downstream from the regulator valve 218, the pressure drops back down below the melting point of the PCM to recharge it (e.g., cause crystallization of the PCM). Thus, the working fluid (e.g., a refrigerant) is sub-cooled as it enters the load 202. However, the amount of heat required to bring the working fluid up to saturation is typically a small fraction of the load 202 and the vast majority of the coolant in the load 202 is at the fixed saturation temperature.

The regulator valve 218 may be configured as an active controlled regulator or may be a passive system. In an active configuration, the temperature of the working fluid may be monitored at one or more locations along the working fluid flow path. For example, a thermal sensor may be arranged, at least, at an inlet side of the PCM heat exchanger 220 to monitor a temperature of the working fluid as it enters the PCM heat exchanger 220. Such temperature feedback information may be used to adjust the pressure drop across the regulator valve 218 to ensure that the temperature of the working fluid is at an appropriate temperature for the specific mode of operation. For example, the pressure drop may be adjusted to cause an increase or decrease in temperature of the working fluid at Point D. Such control can ensure that the temperature is above or below the melting point of the PCM, and thus allows control of a discharging mode or a charging mode of operation. Temperature sensors may be arranged at a variety of locations, such as the various indicated Points A-G, and used to control the state or operation of the regulator valve 218. Such sensors may be in operable communication with a controller 222 or the like, which may control the operation state, and thus pressure drop, across the regulator valve 218. In a passive system, a spring or biased mechanism may be arranged to open and/or close the regulator valve 218 based on a thermally sensitive element arranged, for example, at Point D. That is, as the temperature of the working fluid at Point D deviates from a desired set-point, the regulator valve 218 may automatically respond to the temperatures changes to restrict (i.e., increase pressure drop) or open (i.e., reduce pressure drop) and thus control the temperature of the working fluid at the inlet of the PCM heat exchanger 220.

The thermal management system 200 may provide various advantages over an indirect loop cycle (e.g., as shown in FIG. 1). For example, the thermal management system 200, having a single working fluid and regulator valve can achieve reduced mass and improved efficiency compared to the indirect loop system. In addition, the thermal management system 200 can achieve more rapid control of the outlet temperature of the load in the pumped two-phase loop (e.g., liquid cycle 210), and can enable the use of this improved cycle when the coolant temperature of the electronics must be kept within a tight tolerance. However, if the subcooling is significant compared to the load, a recuperator can be placed upstream from the load to preheat the working fluid. Further, with the inclusion of a recuperator, the hot side of the recuperator may be provided by the fluid leaving the load, there is no concern of boiling the working fluid prior to being supplied to a load for cooling.

Figure 3:
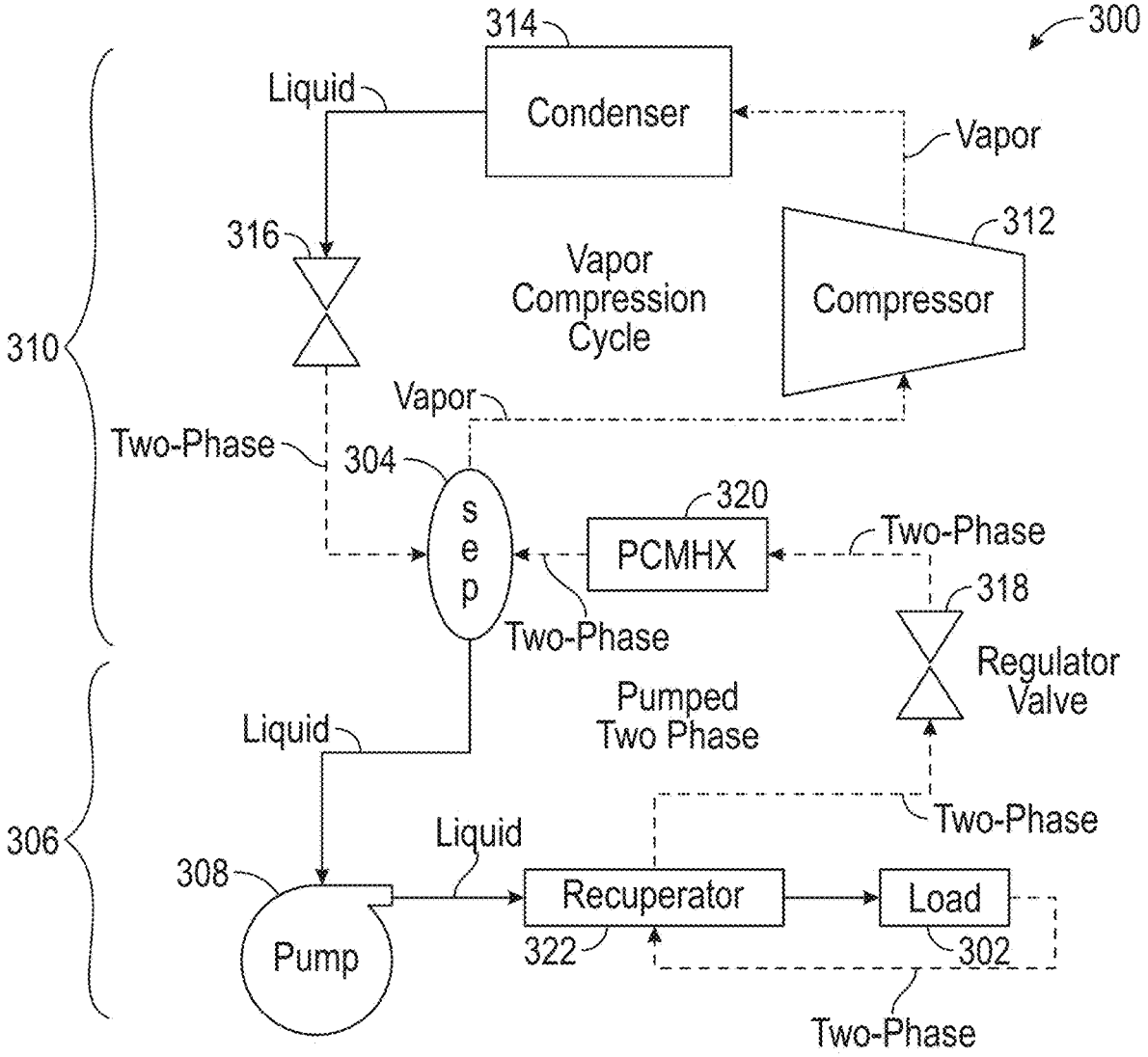
FIG. 3 is a schematic illustration of another single fluid thermal management system in accordance with an embodiment of the present disclosure.

For example, referring now to FIG. 3, a schematic illustration of a single-fluid, two-phase thermal management system 300 in accordance with an embodiment of the present disclosure is shown. The thermal management system 300 may be similar to the thermal management system 200 of FIG. 2 and may employ a single-fluid system that uses a single working fluid for both a vapor compression cycle (e.g., vapor cycle 310) and a pumped two-phase cooling cycle (e.g., liquid cycle 306). The thermal management system 300 is configured to provide cooling to a load 302, similar to that described above. In this configuration, a single working fluid (e.g., a single refrigerant) is used in both cycles of the thermal management system 300, and the working fluid may be a two-phase fluid that may have a vapor phase, a liquid phase, and a two-phase state, which is a mixture of both liquid and vapor phases.

In the thermal management system 300, the vapor cycle 310 is initiated at the separator 304 and a vapor phase of the working fluid is directed toward a compressor 312 and then condensed to a liquid within a condenser 314. The liquid working fluid is then passed through a valve 316 which provides a pressure increase and causes the liquid-phase working fluid to transition into a two-phase working fluid where it is directed back into the separator 304. That is, the vapor cycle 310 of the thermal management system 300 is substantially similar to the vapor cycle 210 of the thermal management system 200 shown in FIG. 3.

In the liquid cycle 306 of the thermal management system 300, they system includes similar components arranged along a flow path of the working fluid. For example, the liquid portion of the working fluid may be directed from the separator 304 to a fluid driver 308, subsequently directed to a load 302 to provide cooling thereto, passed through a regulator valve 318 where the temperature of the working fluid may be adjusted depending on an operational state of a PCM heat exchanger 320. The control of the working fluid temperature may be provided by regulator valve 318 causing a pressure increase or pressure drop and thereby change the temperature of the working fluid.

In this embodiment, however, the thermal management system 300 includes a recuperator 322. The recuperator 322 is arranged along the working fluid flow path both upstream and downstream from the load 302, and the working fluid in the two locations will have thermal exchange therebetween. As shown, a cold side of the recuperator 322 is provided with the working fluid from the fluid driver 308, which is in a liquid state and relatively cold, as it has not picked up heat from the load 302 yet. The hot side of the recuperator 322 is provided with a two-phase working fluid that is sourced from the load 302 after having picked up heat at the load 302. As such, a two-phase state of the working fluid provides the hot side of the recuperator 322. The recuperator 322 may be configured to increase a temperature of the working fluid prior to interacting with the load 302. This may be employed to ensure that the temperature of the working fluid is not too low (e.g., prevent too high a delta temperature between the working fluid and the load 302). Such systems may be used for highly temperature-sensitive loads that may require a very tight temperature range to be maintained, and if the cooling is too extreme, the temperature-sensitive load (e.g., electronics component) may not be able to operate at optimal conditions. Accordingly, the recuperator 322 is provided to maintain substantially constant cooling, even between discharge and recharge modes of operation (e.g., as described above). Because the hot side of the recuperator 322 receives the working fluid from the load 302, and thus is a two-phase state having both liquid and vapor, there is no risk of boiling the working fluid on the cold side of the recuperator 322. Accordingly, liquid working fluid, although warmed in the recuperator 322, is maintained in a liquid state as it is supplied to the load 302.

As noted above, the thermal management system described herein, which employ a single working fluid and a pumped two-phase cycle provide advantages over indirect loop cycles (e.g., shown in FIG. 1). For example, fewer components, piping, maintenance, and the like may be achieved through implementation of embodiments of the present disclosure. Furthermore, improved cooling and reduced system size and weight may be achieved. Additionally, highly accurate or tightly controlled temperature cooling may be provided by embodiments of the present disclosure. Such advantages may be particularly important for aviation applications, where size and weight are important considerations. That is, by incorporate of the regulator valves described herein, the temperature of a working fluid that enters a PCM heat exchanger may be controlled, and thus a recharge or discharge state of operation may be achieved.

Figure 4:
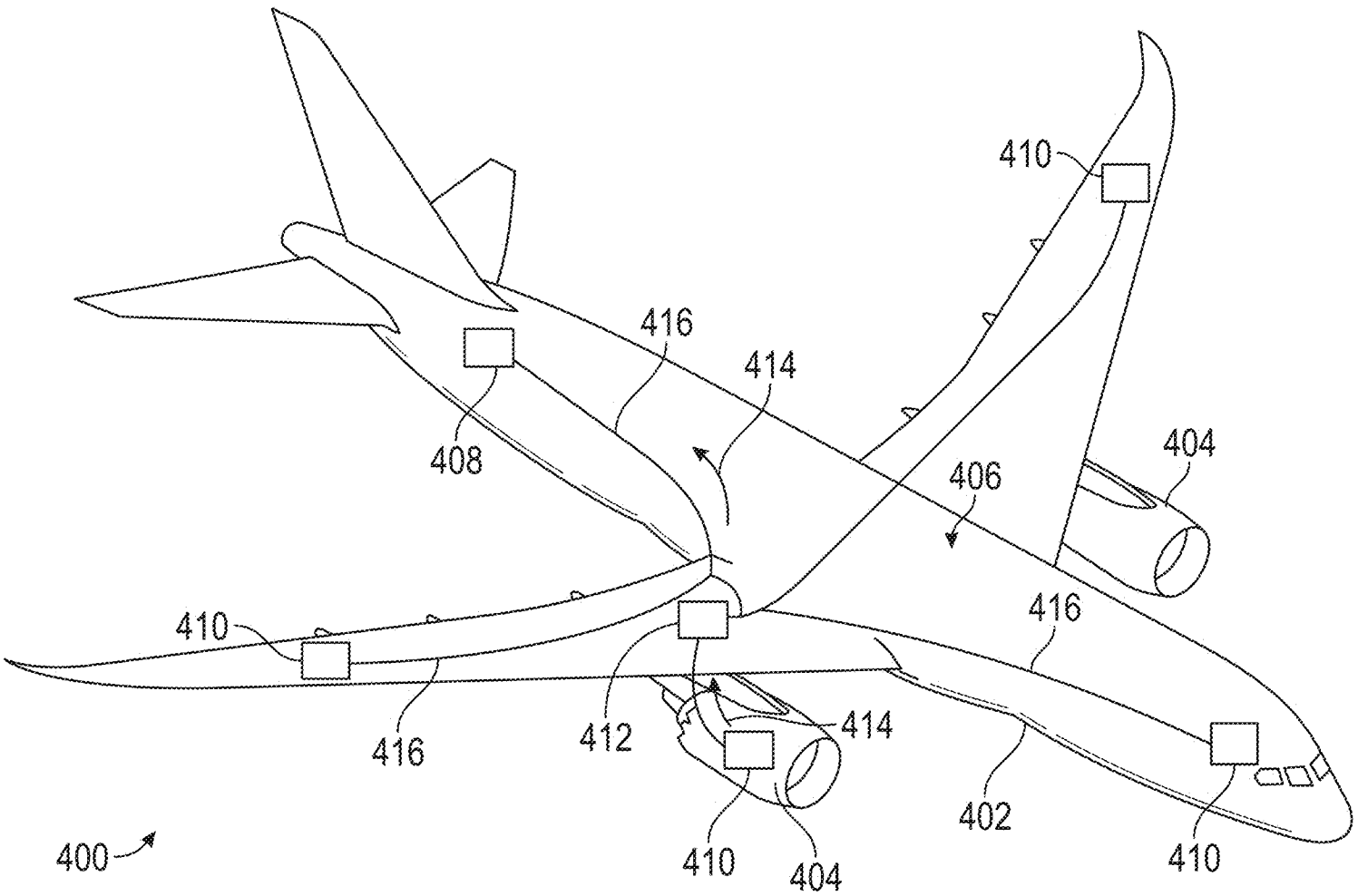
FIG. 4 is a schematic illustration of an aircraft that may incorporate thermal management systems of the present disclosure.

As noted, such thermal management systems may be particularly important in aviation applications. It will be appreciated that the thermal management systems or portions thereof, such as those shown and described above, may be installed onboard an aircraft, such as aircraft 400 shown in FIG. 4. The aircraft 400 includes a fuselage 402, engines 404, and a power system 406. The power system 406 includes the engines 404, one or more electric motors 408, a power bus electrically connecting the various power sources 404, 408, and a plurality of electrical or electronic devices 410 that may be powered by the engines 404 and/or motors 408. The power system 400 includes a power distribution system 412 that distributes power 414 through power lines or cables 416 to the electronic devices 410.

The thermal management systems may be configured to cool onboard heat loads. These onboard configurations may be thermally coupled to or include a cold sink or cold plate (e.g., load) which functions as shown and described above.

As such, a portion of the fluid of the thermal management systems described above may be passed through or used to cool such heat loads. Further, various of the components onboard the aircraft may be highly sensitive components that require a very finely tuned thermal management system to ensure that the sensitive components do not operate outside of optimal thermal conditions. Such components may be controllers, lasers, or the like. For example, sensitive components may require a thermal management system that provides coolant temperatures within a relatively narrow range of temperatures to prevent damage to the sensitive electronic components, such as high energy lasers. As used herein, high energy lasers are lasers with power levels of 10 kW and above. High energy lasers, and other highly sensitive electronics, may operate in a low duty cycle, where the device is at peak power for only a small fraction of the time. Accordingly, the size, weight, and power consumption of the thermal management system can be improved through peak-shaving and/or thermal energy storage. Such features may be provided by the thermal management systems shown and described herein. Although shown to be implemented onboard an aircraft, it will be appreciated that embodiments of the present disclosure may be employed in systems such as motor cooling in electric vehicles, server rack cooling in data centers, ground-based or sea-based applications, or the like, and thus the present disclosure is not intended to be limited to aircraft and/or aviation applications.

The use of the terms "a", "an", "the", and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. As used herein, the terms "about" and "substantially" are intended to include the degree of error associated with measurement of the particular quantity based upon the equipment available at the time of filing the application. For example, the terms may include a range of ±8%, or 5%, or 2% of a given value or other percentage change as will be appreciated by those of skill in the art for the particular measurement and/or dimensions referred to herein.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description but is only limited by the scope of the appended claims.

What is claimed is:

1. A thermal management system comprising:

a vapor cycle and a liquid cycle sharing a common working fluid, wherein the vapor cycle comprises, along a vapor cycle flow path, a compressor and a condenser, and wherein the liquid cycle comprises, along a liquid cycle flow path, a fluid driver, a load, a regulator valve, and a phase change material heat exchanger;

a cold sink thermally coupled to a heat load; and a separator configured to separate a liquid portion and a vapor portion of the working fluid and direct the liquid portion into the liquid cycle and the vapor portion into the vapor cycle, wherein the separator is part of both the vapor cycle and the liquid cycle, wherein the regulator valve is configured to control a temperature of the working fluid within the liquid cycle at least at a location upstream of the phase change material heat exchanger to control a mode of operation of the phase change material heat exchanger between a discharging mode of operation and a recharging mode of operation, wherein, in the discharging mode of operation, the temperature of the working fluid upstream of the phase change material heat exchanger is higher than a melting point of a phase change material of the phase change material heat exchanger, and wherein, in the recharging mode of operation, the temperature of the working fluid upstream of the phase change material heat exchanger is less than a melting point of a phase change material of the phase change material heat exchanger.

2. The thermal management system of claim 1, wherein the regulator valve is actively controlled to adjust a pressure drop across the regulator valve to adjust the temperature of the working fluid upstream of the phase change material heat exchanger.

3. The thermal management system of claim 2, further comprising:

at least one temperature sensor arranged on the liquid cycle to measure a temperature of the working fluid; and a controller operably connected to the regulator valve and configured to receive temperature information from the at least one temperature sensor.

4. The thermal management system of claim 1, wherein the regulator valve is passively controlled in response to a temperature of the working fluid passing through the regulator valve.

5. The thermal management system of claim 1, further comprising a recuperator arranged on the liquid cycle at a position upstream from the load to receive a first pass of the working fluid and at a position downstream from the load to receive a second pass of the working fluid to cause a thermal exchange between a heated portion of the working fluid downstream from the load and a relatively colder portion of the working fluid upstream from the load.

6. The thermal management system of claim 5, wherein the heated portion of the working fluid passes from the recuperator to the regulator valve.

7. The thermal management system of claim 1, wherein the load is an onboard aircraft load.

8. The thermal management system of claim 7, wherein the load is a high energy laser.

9. A method of operating a thermal management system, the thermal management system comprising a vapor cycle and a liquid cycle sharing a common working fluid, wherein the vapor cycle comprises, along a vapor cycle flow path, a compressor and a condenser, and wherein the liquid cycle comprises, along a liquid cycle flow path, a fluid driver, a load, a regulator valve, and a phase change material heat exchanger, a cold sink thermally coupled to a heat load, and a separator configured to separate a liquid portion and a vapor portion of the working fluid and direct the liquid portion into the liquid cycle and the vapor portion into the vapor cycle, wherein the separator is part of both the vapor cycle and the liquid cycle, the method comprising:

controlling a temperature of the working fluid within the liquid cycle at least at a location upstream of the phase change material heat exchanger using the regulator valve to control a mode of operation of the phase change material heat exchanger between a discharging mode of operation and a recharging mode of operation, wherein, in the discharging mode of operation, the temperature of the working fluid upstream of the phase change material heat exchanger is higher than a melting point of a phase change material of the phase change material heat exchanger, and wherein, in the recharging mode of operation, the temperature of the working fluid upstream of the phase change material heat exchanger is less than a melting point of a phase change material of the phase change material heat exchanger.

10. The method of claim 9, wherein the regulator valve is actively controlled to adjust a pressure drop across the regulator valve to adjust the temperature of the working fluid upstream of the phase change material heat exchanger.

11. The method of claim 10, further comprising:

measuring a temperature of the working fluid with at least one temperature sensor arranged on the liquid cycle; and using a controller operably connected to the regulator valve to receive temperature information from the at least one temperature sensor and adjust the regulator valve in response to the measured temperature.

12. The method of claim 9, wherein the regulator valve is passively controlled in response to a temperature of the working fluid passing through the regulator valve.

13. The method of claim 9, further comprising a recuperator arranged on the liquid cycle at a position upstream from the load to receive a first pass of the working fluid and at a position downstream from the load to receive a second pass of the working fluid to cause a thermal exchange between a heated portion of the working fluid downstream from the load and a relatively colder portion of the working fluid upstream from the load.

14. The method of claim 13, wherein the heated portion of the working fluid passes from the recuperator to the regulator valve.

15. The method of claim 9, wherein the load is an onboard aircraft load.

16. The method of claim 15, wherein the load is a high energy laser.

* * * * *